US011210945B2

(12) United States Patent
Kourous-Harrigan et al.

(10) Patent No.: US 11,210,945 B2
(45) Date of Patent: Dec. 28, 2021

(54) INFRASTRUCTURE SYSTEM

(71) Applicant: Ford Global Technologies, LLC, Dearborn, MI (US)

(72) Inventors: Helen Kourous-Harrigan, Monroe, MI (US); Linjun Zhang, Canton, MI (US); John Anthony Lockwood, Howell, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 16/822,583

(22) Filed: Mar. 18, 2020

(65) Prior Publication Data

US 2021/0295688 A1 Sep. 23, 2021

(51) Int. Cl.

| | |
|---|---|
| ***G08G 1/0967*** | (2006.01) |
| ***G08G 1/01*** | (2006.01) |
| ***E01F 9/50*** | (2016.01) |
| ***E01F 9/30*** | (2016.01) |

(52) U.S. Cl.

CPC ..... *G08G 1/096783* (2013.01); *E01F 9/30* (2016.02); *E01F 9/50* (2016.02); *G08G 1/0116* (2013.01); *G08G 1/0133* (2013.01); *G08G 1/0141* (2013.01); *G08G 1/0145* (2013.01)

(58) Field of Classification Search

CPC ..... G08G 1/096783; G08G 1/0145; G08G 1/0116; G08G 1/0141; G08G 1/0133; E01F 9/30; E01F 9/50

See application file for complete search history.

(56) References Cited

U.S. PATENT DOCUMENTS

| | | | | |
|---|---|---|---|---|
| 10,160,378 | B2 | 12/2018 | Sweeney et al. | |
| 10,222,773 | B2 | 3/2019 | Funk et al. | |
| 2005/0104745 | A1* | 5/2005 | Bachelder | G08G 1/07 340/906 |
| 2010/0070167 | A1* | 3/2010 | Mudalige | G01C 21/26 701/31.4 |
| 2017/0153714 | A1* | 6/2017 | Gao | G06K 9/00798 |
| 2018/0334089 | A1 | 11/2018 | Huang et al. | |
| 2019/0017839 | A1* | 1/2019 | Eyler | G02B 27/0101 |

(Continued)

OTHER PUBLICATIONS

"Augmented reality navigation overlays direction information onto the road", CES 2019: AR Navigation Overlays Directions Onto Roads | Digital Trends, Aug. 5, 2019, https://www.digitaltrends.com/cars/ar-navgation-hyundai-wayray-ces-2019/.

*Primary Examiner* — Brian Wilson
(74) *Attorney, Agent, or Firm* — Brandon Hicks; Bejin Bieneman PLC

(57) ABSTRACT

An infrastructure system includes at least one sensor, a transceiver, and a computer communicatively coupled to the at least one sensor and to the transceiver. The computer is programmed to receive data from the at least one sensor indicating respective locations and motions of objects in an environment surrounding the at least one sensor; in response to one of (a) the data from the at least one sensor or (b) a request from a user, generate a virtual traffic marker at a first location in the environment; and instruct the transceiver to broadcast the virtual traffic marker to vehicles in the environment. The first location is based on the data from the at least one sensor, and the virtual traffic marker is data including the first location and traffic instructions corresponding to the first location.

20 Claims, 8 Drawing Sheets

(56) References Cited

U.S. PATENT DOCUMENTS

| | | | | |
|---|---|---|---|---|
| 2019/0051150 | A1* | 2/2019 | Anderson | G08G 1/162 |
| 2020/0010095 | A1* | 1/2020 | Kim | B60W 60/001 |
| 2020/0164799 | A1* | 5/2020 | Nowakowski | B60R 1/00 |

* cited by examiner

INFRASTRUCTURE SYSTEM

BACKGROUND

Vehicles can be autonomous or semi-autonomous. In an autonomous or semi-autonomous vehicle, a vehicle computer can be programmed to operate the vehicle independently of the intervention of a human driver, completely or to a lesser degree. The vehicle computer may be programmed to operate the propulsion, brake system, steering, and/or other vehicle systems based on data received from sensors mounted to the vehicle. The computer may be able to recognize and/or interpret traffic markers, i.e., objects in an environment in which the vehicle is operating that provide instructions for vehicle operation in the environment. Vehicle operation may be affected by traffic markers.

DETAILED DESCRIPTION

Figure 1:
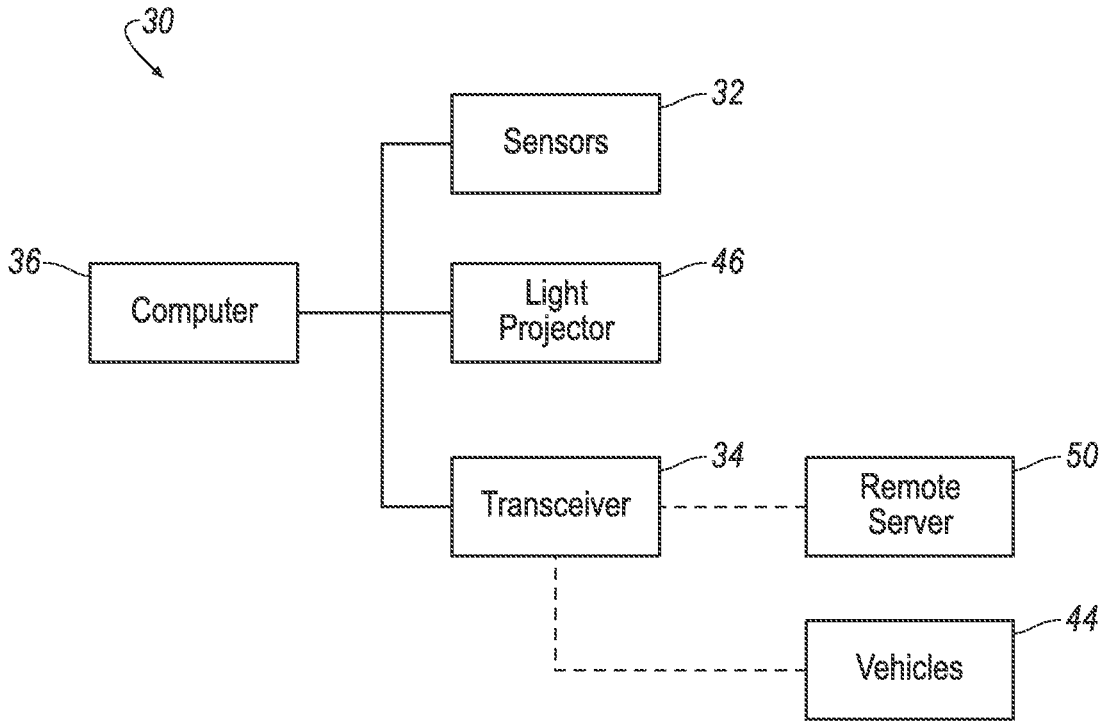
FIG. 1 is a block diagram of an example vehicle infrastructure system.

To provide more efficient vehicle operation, the infrastructure system described herein can provide dynamically changing traffic markers and propagate these traffic markers to vehicles and other road users in an environment surrounding the infrastructure system. The propagation can be both physically manifested (viewable by a pedestrian) and virtual (electronically transmitted to vehicle computers). Unlike traditional traffic markers, which are static, the dynamically changing traffic markers are adaptable to optimize for immediate local traffic conditions. By dynamically changing the traffic markers, the traffic patterns in the environment can respond to changing demands by vehicles and by users who are pedestrians. For example, a traffic marker such as a crosswalk can be generated when one or more pedestrians wants to cross a roadway, but omitted so that vehicles can travel unrestricted by the crosswalk when no pedestrian demand exists; the number of lanes of traffic in each direction can change when traffic flow is much heavier one direction than the other; parking spaces can be redesignated as a pickup/dropoff zone when one or more users wants but remain as parking spaces otherwise; etc. The infrastructure system thus increases the efficiency of both vehicle traffic and pedestrian traffic through the environment.

An infrastructure system includes at least one sensor, a transceiver, and a computer communicatively coupled to the at least one sensor and to the transceiver. The computer is programmed to receive data from the at least one sensor indicating respective locations and motions of objects in an environment surrounding the at least one sensor; in response to one of (a) the data from the at least one sensor or (b) a request from a user, generate a virtual traffic marker at a first location in the environment, wherein the first location is based on the data from the at least one sensor or included in the request, and the virtual traffic marker is data including the first location and traffic instructions corresponding to the first location; and instruct the transceiver to broadcast the virtual traffic marker to vehicles in the environment.

The virtual traffic marker may include at least one of a virtual parking place, a virtual crosswalk, a virtual lane-direction indicator, a virtual lane marker, a virtual designation of a road as a toll road, or a virtual pickup/dropoff zone.

Instructing the transceiver to broadcast the virtual traffic marker may include instructing the transceiver to broadcast map data including the virtual traffic marker.

The sensor may include at least one of a camera or a LIDAR.

The infrastructure system may include a light projector communicatively coupled to the computer, the virtual traffic marker may be a virtual crosswalk, and the computer may be further programmed to, in response to the request from the user to generate the virtual crosswalk, generate the virtual crosswalk at the first location, and instruct a light projector to project light in a shape indicating the virtual crosswalk at the first location in the environment.

A computer includes a processor and a memory storing instructions executable by the processor to receive data from at least one sensor indicating locations and motions of objects in an environment surrounding the at least one sensor; in response to one of (a) the data from the at least one sensor or (b) a request from a user, generate a virtual traffic marker at a first location in the environment, wherein the first location is based on the data from the at least one sensor or included in the request, and the virtual traffic marker is data including the first location and traffic instructions corresponding to the first location; and instruct a transceiver to broadcast the virtual traffic marker to vehicles in the environment.

The virtual traffic marker may include at least one of a virtual parking place, a virtual crosswalk, a virtual lane-direction indicator, a virtual lane marker, a virtual designation of a road as a toll road, or a virtual pickup/dropoff zone.

Instructing the transceiver to broadcast the virtual traffic marker may include instructing the transceiver to broadcast map data including the virtual traffic marker.

The virtual traffic marker may be a virtual crosswalk, and the instructions may further include to, in response to the request from the user to generate the virtual crosswalk, generate the virtual crosswalk at the first location. The instructions may further include to instruct a light projector to project light in a shape indicating the virtual crosswalk at the first location in the environment.

The request from the user may include the first location.

The instructions may further include to decline to generate the virtual crosswalk upon determining that an area encompassed by the virtual crosswalk intersects at least one object that is stationary in the environment.

The instructions may further include to decline to generate the virtual crosswalk upon determining that a priority vehicle is approaching the first location.

The virtual traffic marker may be a virtual lane-direction indicator; the instructions may further include to, in response to the data from the at least one sensor indicating that traffic in a first direction along a roadway is above a first traffic density threshold and that traffic in a second direction opposite the first direction along the roadway is below a second traffic density threshold, generate the virtual lane-direction indicator; and the first location may indicate a lane of the roadway. The first traffic density threshold may be greater than the second traffic density threshold, and the virtual lane-direction indicator points in the first direction.

The virtual traffic marker may be a virtual pickup/dropoff zone, and the instructions may further include to, in response to the request from the user to generate the virtual pickup/dropoff zone, generate the virtual pickup/dropoff zone at the first location. The first location may be based on data from the at least one sensor indicating locations of stationary vehicles in the environment. The instructions may further include determining the first location as where a minimum distance along a roadside is unoccupied by stationary vehicles. The minimum distance may be at least as long as two consecutive parallel parking spaces.

A method includes receiving data from at least one sensor indicating locations and motions of objects in an environment surrounding the at least one sensor; in response to one of (a) the data from the at least one sensor or (b) a request from a user, generating a virtual traffic marker at a first location in the environment, wherein the first location is based on the data from the at least one sensor or included in the request, and the virtual traffic marker is data including the first location and traffic instructions corresponding to the first location; and instructing a transceiver to broadcast the virtual traffic marker to vehicles in the environment.

With reference to the Figures, an infrastructure system 30 includes at least one sensor 32, a transceiver 34, and a computer 36 communicatively coupled to the at least one sensor 32 and to the transceiver 34. The computer 36 is programmed to receive data from the at least one sensor 32 indicating respective locations and motions of objects 38 in an environment surrounding the at least one sensor 32; in response to one of (a) the data from the at least one sensor 32 or (b) a request from a user 40, generate a virtual traffic marker 42 at a first location 54 in the environment; and instruct the transceiver 34 to broadcast the virtual traffic marker 42 to vehicles 44 in the environment. The first location 54 is based on the data from the at least one sensor 32, and the virtual traffic marker 42 is data including the first location 54 and traffic instructions corresponding to the first location 54.

With reference to FIG. 1, the infrastructure system 30 includes the sensors 32, a light projector 46, the computer 36, and the transceiver 34. The infrastructure system 30 is mounted in a fixed position in an environment including one or more roads on which vehicles 44 can travel, as shown in FIGS. 4, 6A-B, and 8. The infrastructure system 30 can be positioned to give the sensors 32 a broad view of the environment, e.g., mounted on a streetlight or traffic light.

The sensors 32 detect the external world, e.g., objects 38 and/or characteristics of the environment, such as the vehicles 44, road lane markings, traffic lights and/or signs, pedestrians, cyclists, other objects 38, etc. For example, the sensors 32 can include at least one of a camera or a LIDAR. A LIDAR detects distances to objects 38 by emitting laser pulses at a particular wavelength and measuring the time of flight for the pulse to travel to something in the environment and back. The at least one sensor 32 can include multiple sensors, e.g., a complementary metal-oxide semiconductor (CMOS) camera, an infrared camera, a LIDAR, and a radar sensor.

The light projector 46 may be any lighting system suitable for illuminating a roadway 52 beside the infrastructure system 30, including tungsten, halogen, high-intensity discharge (HID) such as xenon, light-emitting diode (LED), laser, etc. The light projector 46 can switch between projecting light projections 48 of different shapes and/or different locations on the ground. For example, the light projector 46 may include a plurality of bulbs, and illuminating different arrangements of the bulbs results in light projections 48 of different shapes or locations projected by the light projector 46 on the ground. For another example, the light projector 46 may include a plurality of stencils, and shining light through respective stencils projects light projections 48 of different shapes or locations on the ground. For another example, the light projector 46 may include a single stencil and multiple bulbs of different orientations behind the stencil, and illuminating different bulbs projects light projections 48 of the same shape in different locations on the ground.

The computer 36 is a microprocessor-based computing device, e.g., an electronic controller or the like. The computer 36 includes a processor, a memory, etc. The memory of the computer 36 includes media for storing instructions executable by the processor as well as for electronically storing data and/or databases. The computer 36 is communicatively coupled to the sensors 32, the light projector 46, and the transceiver 34, e.g., by a communications bus. The computer 36 can be mounted in the same location as the sensors 32.

The transceiver 34 is adapted to transmit signals wirelessly through any suitable wireless communication protocol, such as Bluetooth®, WiFi, IEEE 802.11a/b/g, IEEE 802.11p (Dedicated Short-Range Communications (DSRC)), cellular-vehicle-to-everything (CV2X), other RF (radio frequency) communications, etc. The transceiver 34 is adapted to communicate with a remote server 50, that is, a server distinct and spaced from the infrastructure system 30. The remote server 50 is located outside the infrastructure system 30. For example, the remote server 50 may be associated with a vehicle 44 (e.g., V2I communications via DSRC or the like), a priority vehicle 44, a command center, a mobile device associated with the user 40, etc. The transceiver 34 may be one device or may include a separate transmitter and receiver.

The vehicles 44 can be any passenger or commercial automobiles such as cars, trucks, sport utility vehicles, crossovers, vans, minivans, taxis, buses, etc. The vehicles 44 can be autonomous or semi-autonomous. For each vehicle 44, a vehicle computer can be programmed to operate the vehicle 44 independently of the intervention of a human driver, completely or to a lesser degree. The vehicle computer may be programmed to operate the propulsion, brake system, steering, and/or other vehicle systems. For the purposes of this disclosure, autonomous operation means the vehicle computer controls the propulsion, brake system, and steering without input from a human driver; semi-autonomous operation means the vehicle computer controls one or two of the propulsion, brake system, and steering and a human driver controls the remainder; and nonautonomous operation means a human driver controls the propulsion, brake system, and steering.

The infrastructure system 30 can be located in a geofenced area in which the vehicles 44 operate. For the purposes of this disclosure, a "geofenced area" is a geographic region enclosed by a virtual boundary, i.e., an artificial border. The virtual boundary of the geofenced area can be stored in the memory of the computer 36, e.g., as a series of interconnected geographical coordinates, as well as in the memories of vehicle computers in the vehicles 44. The geofenced area can be associated with rules for the vehicles 44, e.g., that vehicles 44 are permitted to operate autonomously inside the geofenced area but not outside the geofenced area, and/or that nonautonomous vehicles are prohibited inside the geofenced area.

Figure 2:
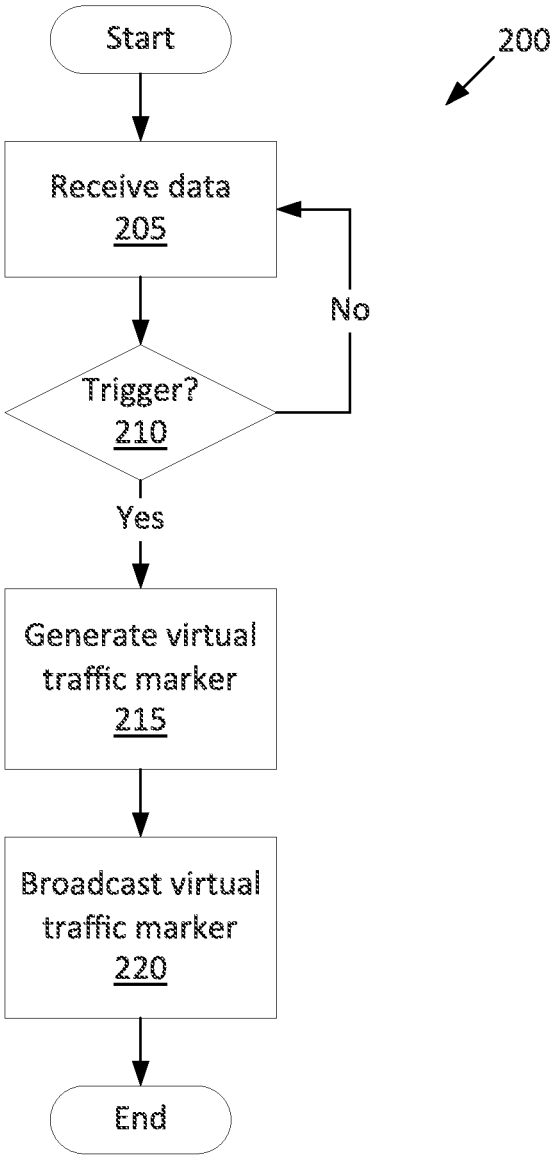
FIG. 2 is a process flow diagram of an example process for generating a virtual traffic marker.

FIG. 2 is a process flow diagram illustrating an exemplary process 200 for generating the virtual traffic marker 42. The memory of the computer 36 stores executable instructions for performing the steps of the process 200. As a general overview of the process 200, the computer 36 receives data, determines whether the data indicates that a trigger has occurred, and if so, generates and broadcasts the virtual traffic marker 42. The process 200 is a general case of generating the virtual traffic marker 42, and processes 300, 500, and 700 in FIGS. 3, 5, and 7, respectively, are specific examples of generating the virtual traffic marker 42, i.e., more detailed implementations of the process 200.

The process 200 begins in a block 205, in which the computer 36 receives data. The data includes data from the at least one sensor 32 indicating respective locations and motions of the objects 38 in the environment surrounding the at least one sensor 32. For example, the data for each object 38 can have the form $(x, y, \theta, v_x, v_y, \omega)$, in which x and y are horizontal spatial coordinates, $\theta$ is a horizontal orientation, $v_x$ and $v_y$ are horizontal velocity components, and $\omega$ is a horizontal angular velocity. For further examples, see the descriptions with respect to blocks 305, 505, and 705 below. The data can include a request from the user 40. The request can include a type of the virtual traffic marker 42 and possibly a first location 54 of the virtual traffic marker 42. For example, see the description with respect to blocks 310 and 710 below.

Next, in a decision block 210, the computer 36 determines whether a trigger has occurred or been detected. A "trigger," in the present context, is data specifying that one or more criteria for an action, e.g., generation of a virtual traffic marker 42, have been met. For example, the trigger can be that the data from the at least one sensor 32 indicate that one or more criteria have been met. For example, traffic in a first direction along a roadway 52 is above a first traffic density threshold, and traffic in a second direction along the roadway 52 is below a second traffic density threshold, as described in more detail below with respect to decision blocks 515 and 520 of the process 500. Alternatively or additionally, the trigger can be a request from the user 40, as in blocks 315 and 715 below. If the trigger has not occurred, the process 200 returns to the block 205 to continue receiving data. If the trigger has occurred, the process 200 proceeds to a block 215.

In the block 215, the computer 36 generates the virtual traffic marker 42 at the first location 54 in the environment. The virtual traffic marker 42 is data including the first location 54 and traffic instructions corresponding to the first location 54. "Traffic instructions" are rules promulgated by a relevant authority having jurisdiction over the environment, e.g., a governmental entity, a property owner, etc., and governing which actions a vehicle 44 must perform or is prohibited from performing. For example, the virtual traffic marker 42 includes at least one of a virtual parking place, a virtual crosswalk 42*a*, a virtual lane-direction indicator 42*b* (as in block 525 below), a virtual lane marker, a virtual designation of a road as a toll road, or a virtual pickup/dropoff zone 42*c*. The virtual traffic marker 42 can be map data. The first location 54 can be based on, i.e., partly or wholly determined from, the data from the at least one sensor 32. For example, the first location 54 can be where a minimum distance along a first roadside 56 is unoccupied by stationary vehicles 44, i.e., based on data about the parked vehicles 44 along the first roadside 56, as described in more detail below with respect to blocks 720 and 725 of the process 700. The first location 54 can be based on the request from the user 40, i.e., the request can include data identifying the first location 54, e.g., as described with respect to block 330 below.

Next, in a block 220, the computer 36 instructs the transceiver 34 to broadcast the virtual traffic marker 42 to the vehicles 44 in the environment. For example, the transceiver 34 can broadcast map data including the virtual traffic marker 42, such as an update to a map stored on the vehicle computers of the vehicles 44, e.g., as described with respect to blocks 335, 530, and 730 below. For the purposes of this disclosure, "broadcast" is defined as transmitting data to potentially many recipients without necessarily receiving data from those recipients. The computer 36 may transmit the virtual traffic marker 42 to a cloud server to transmit to more distant vehicles 44 depending on how long the virtual traffic marker 42 is expected to persist. If the virtual traffic marker 42 has an indefinite duration, the computer 36 transmits the virtual traffic marker 42 to the cloud server, e.g., as described below with respect to a block 530, and if the virtual traffic marker 42 is temporary, the computer 36 does not transmit to the cloud server, as is true for the processes 300 and 700. Additionally, the computer 36 may instruct the light projector 46 to project a light projection 48 indicating, e.g., visually depicting, the virtual traffic marker 42, e.g., as described with respect to a block 340 below. The light projection 48 is visible to users 40 who are pedestrians, and the light projection 48 can be complementary to the virtual traffic marker 42 for vehicles 44 because the vehicles 44, which are autonomous, can see the light projection 48 with on-board sensors and react accordingly. After the block 220, the process 200 ends.

Figure 3:
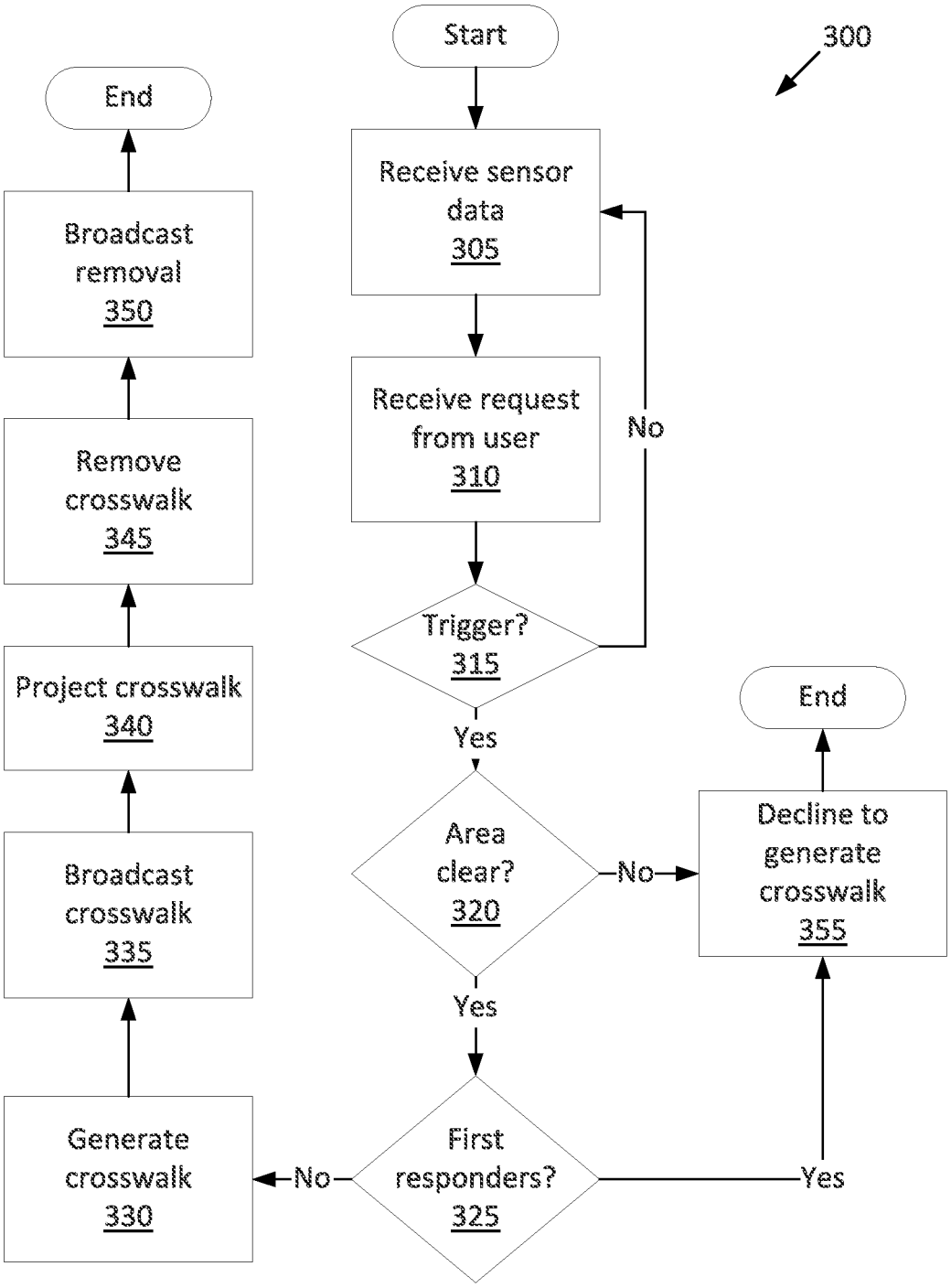
FIG. 3 is a process flow diagram of an example process for generating a virtual crosswalk.

FIG. 3 is a process flow diagram illustrating an exemplary process 300 for generating a virtual traffic marker 42, in which the virtual traffic marker 42 is a virtual crosswalk 42*a*. The memory of the computer 36 stores executable instructions for performing the steps of the process 300. As a general overview of the process 300, the computer 36 receives sensor data and a request from a user 40; in response to the request, if the location is clear of objects 38 and no first responders are approaching, generates and broadcasts the virtual crosswalk 42*a*, projects a virtual crosswalk 42*a* with the light projector 46, and then removes the crosswalk and broadcasts the removal; and in response to the request, if the location is obstructed or if first responders are approaching, declines to generate the virtual crosswalk 42*a*.

Figure 4:
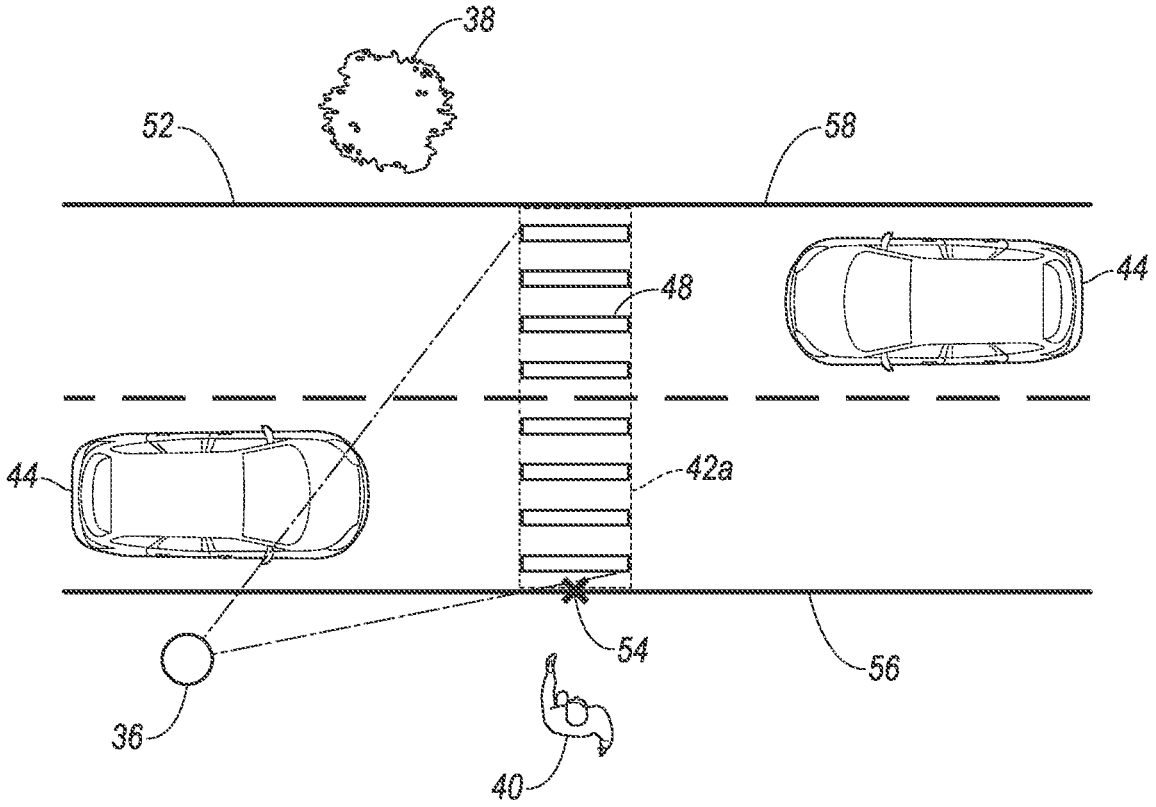
FIG. 4 is a diagram of the infrastructure system generating the virtual crosswalk.

The process 300 begins in a block 305, in which the computer 36 receives data from the at least one sensor 32 indicating respective locations and motions of the objects 38 in the environment surrounding the at least one sensor 32. For example, the data for each object 38 can have the form $(x, y, \theta, v_x, v_y, \omega)$, in which x and y are horizontal spatial coordinates, $\theta$ is a horizontal orientation, $v_x$ and $v_y$ are horizontal velocity components, and $\omega$ is a horizontal angular velocity. The objects 38 can be vehicles 44, as shown in FIG. 4.

Next, in a block 310, the computer 36 receives the request from the user 40. The request includes data indicating that the user 40 wants a virtual crosswalk 42*a* generated for crossing a roadway 52 and indicating a first location 54 at which the user 40 wants the virtual crosswalk 42*a* generated. For example, the first location 54 can be at a spatial coordinate representing the point closest to the user 40 at a first roadside 56 of the roadway 52 at which the user 40 is located. The computer 36 can use the first location 54 as a reference point from which to locate the area encompassed by the virtual crosswalk 42*a*. For example, the virtual crosswalk 42*a* can have a center point that is within a maximum distance from the first location 54 and is selected so that the virtual crosswalk 42*a* is unobstructed by stationary objects 38 while being closest to the first location 54 (e.g., identical to the first location 54 as shown in FIG. 4). The maximum distance is chosen to be an acceptable walking distance for the user 40, e.g., 5 meters. Then the virtual crosswalk 42*a* occupies a predefined width along the first roadside 56 of the roadway 52 that is centered on the center point, and the virtual crosswalk 42*a* can extend perpendicular from the first roadside 56 of the roadway 52 to a second roadside 58 of the roadway 52 opposite the first roadside 56, as shown in FIG. 4.

Next, in a block 315, the computer 36 determines whether the request from the user 40 to generate the virtual crosswalk 42*a* has been received by the transceiver 34. In response to the request, the process 300 proceeds to a decision block 320. If no request has been received, the process 300 returns to the block 305 to continue monitoring the data from the at least one sensor 32 and awaiting the request.

In the decision block 320, the computer 36 determines whether an area encompassed by the virtual crosswalk 42*a* intersects at least one object 38 that is stationary in the environment, e.g., a parked vehicle 44. For example, to make this determination, the computer 36 can determine whether a two-dimensional horizontal shape exists that is encompassed by the virtual crosswalk 42*a* and encompassed by the stationary object 38. If the area encompassed by the virtual crosswalk 42*a* does not intersect any stationary objects 38, the process 300 proceeds to a decision block 325. If the area encompassed by the virtual crosswalk 42*a* intersects a stationary object 38, the process 300 proceeds to a block 355.

In the decision block 325, the computer 36 determines whether a priority vehicle 44 (i.e., a vehicle such as a first-responder vehicle responding to an emergency, to which other vehicles are required to yield) is approaching the first location 54. For example, the computer 36 can identify an object 38 as a priority vehicle 44 and can determine that the object 38 has a trajectory ($v_x$, $v_y$) along the roadway 52 toward the first location 54. The computer 36 can identify the object 38 as a priority vehicle 44 based on a message received from the priority vehicle 44 identifying itself as such. Alternatively or additionally, the computer 36 can identify the object 38 as a priority vehicle 44 using conventional image-recognition techniques, e.g., a convolutional neural network programmed to accept images as input and output an identified vehicle type. A convolutional neural network includes a series of layers, with each layer using the previous layer as input. Each layer contains a plurality of neurons that receive as input data generated by a subset of the neurons of the previous layers and generate output that is sent to neurons in the next layer. Types of layers include convolutional layers, which compute a dot product of a weight and a small region of input data; pool layers, which perform a downsampling operation along spatial dimensions; and fully connected layers, which generate based on the output of all neurons of the previous layer. The final layer of the convolutional neural network generates a score for each potential vehicle type, and the final output is the vehicle type with the highest score. The object 38 is a priority vehicle 44 if the vehicle type with the highest score is priority vehicle 44. If no priority vehicle 44 is approaching the first location 54, the process 300 proceeds to a block 330. If a priority vehicle 44 is approaching the first location 54, the process proceeds to the block 355.

In the block 330, the computer 36 generates the virtual crosswalk 42*a* at the first location 54 in the environment. The virtual traffic marker 42 can be represented as map data. For example, the virtual crosswalk 42*a* can be represented as a set of vertices of the area encompassed by the virtual crosswalk 42*a*. The area encompassed by the virtual crosswalk 42*a* is based on the first location 54 received in the request, as described above with respect to the block 310. For another example, the virtual crosswalk 42*a* can be represented as the first location 54 and an identifier of the roadway 52 across which the virtual crosswalk 42*a* extends.

Next, in a block 335, the computer 36 instructs the transceiver 34 to broadcast the virtual crosswalk 42*a* to the vehicles 44 in the environment. For example, the transceiver 34 can broadcast map data including the virtual crosswalk 42*a*, such as an update to a map stored on the vehicle computers of the vehicles 44.

Next, in a block 340, the computer 36 instructs the light projector 46 to project a light projection 48 in a shape indicating the virtual crosswalk 42*a* at the first location 54 in the environment, as shown in FIG. 4. The shape of the light projection 48 that is projected by the light projector 46 can be chosen to correspond to a standard appearance of a crosswalk in a jurisdiction in which the light projector 46 is located, e.g., thick, equally spaced bars extending parallel to the direction of the roadway 52 and arranged across the roadway 52. The computer 36 can wait for a preset time before executing the block 340. The preset time can be chosen to allow the vehicles 44 sufficient time to recognize and react to the virtual crosswalk 42*a*. At the same time as projecting the shape indicating the virtual crosswalk 42*a*, the computer 36 can instruct the transceiver 34 to send a message to the user 40 indicating that the virtual crosswalk 42*a* has been generated and broadcast to the vehicles 44. The light projection 48 is visible to users 40 who are pedestrians, and the light projection 48 can be complementary to the virtual traffic marker 42 for vehicles 44 because the vehicles 44, which are autonomous, can see the light projection 48 with on-board sensors and react accordingly, e.g., by slowing and checking for pedestrians.

Next, in a block 345, the computer 36 removes the virtual crosswalk 42*a*. For example, the computer 36 can generate map data in which the map reverts to its state from before the virtual crosswalk 42*a* was generated. For example, the computer 36 can wait for a preset time before executing the block 345. The preset time can be chosen to allow the user 40 sufficient time to cross the roadway 52 using the virtual crosswalk 42*a*. For another example, the computer 36 can wait for a dynamic time until the computer 36 determines that the user 40 has crossed the roadway 52 based on data received from the at least one sensor 32.

Next, in a block 350, the computer 36 instructs the transceiver 34 to broadcast the removal of the virtual crosswalk 42*a* to the vehicles 44 in the environment. For example, the transceiver 34 can broadcast map data excluding the virtual crosswalk 42*a*, such as an update to a map stored on the vehicle computers reverting the map to its state from before the virtual crosswalk 42*a* was generated. The computer 36 also instructs the light projector 46 to cease projecting the light projection 48. After the block 350, the process 300 ends.

The block 355 can occur after the decision block 320 if the area encompassed by the virtual crosswalk 42*a* intersects a stationary object 38, or after the decision block 325 if a priority vehicle 44 is approaching the first location 54. In the block 355, the computer 36 declines to generate the virtual crosswalk 42*a*. The computer 36 can instruct the transceiver 34 to send a message to the user 40 indicating that the virtual crosswalk 42*a* will not be created. The message may include a statement of the reason for declining, e.g., that the area encompassed by the virtual crosswalk 42*a* is obstructed or that a priority vehicle 44 is approaching. After the block 355, the process 300 ends.

Figure 5:
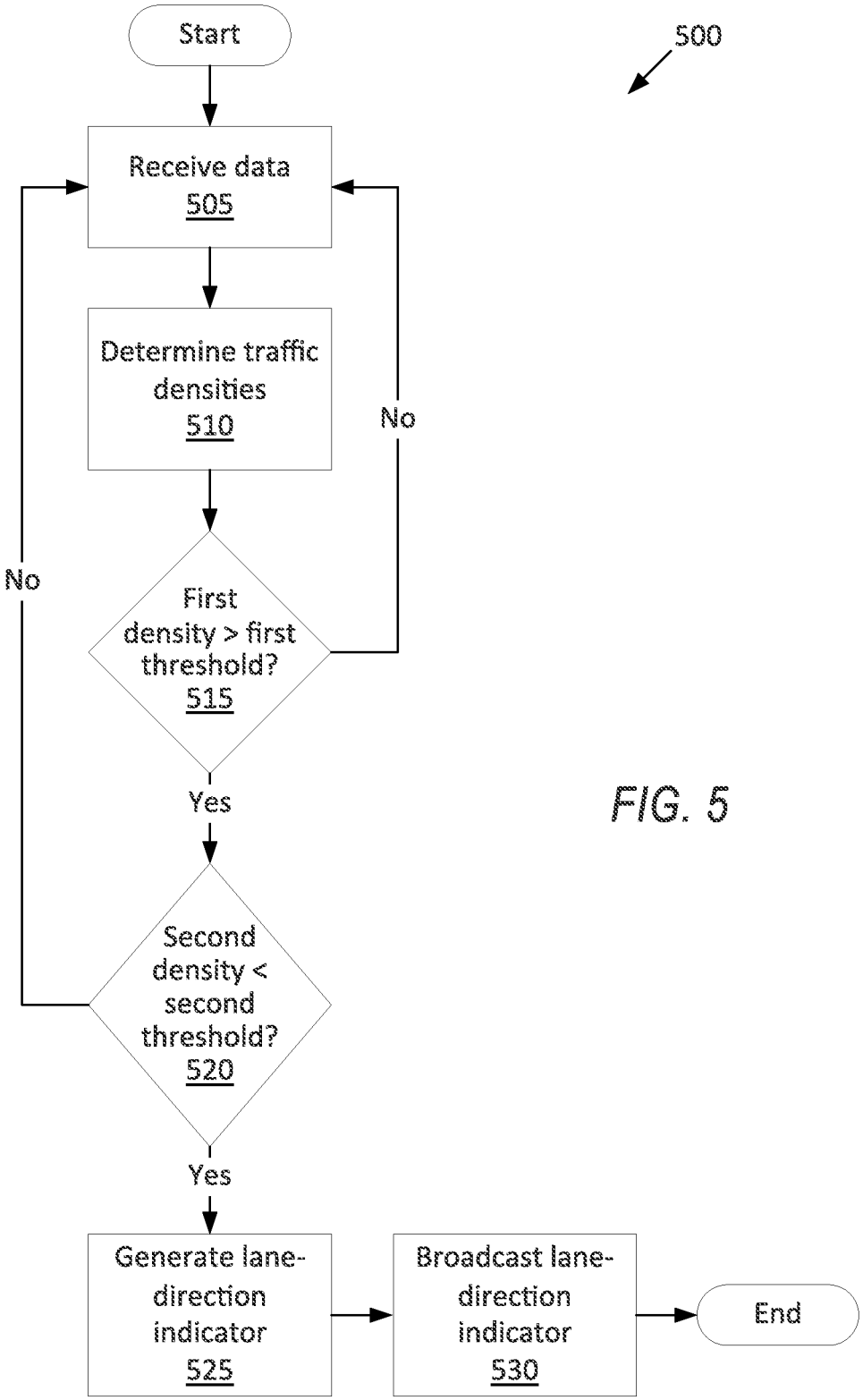
FIG. 5 is a process flow diagram of an example process for generating a virtual lane-direction indicator.

FIG. 5 is a process flow diagram illustrating an exemplary process 500 for generating a virtual traffic marker 42, in which the virtual traffic marker 42 is a virtual lane-direction indicator 42*b*. The memory of the computer 36 stores executable instructions for performing the steps of the process 500. As a general overview of the process 500, the computer 36 receives sensor data, determines a first traffic density in a first direction along a roadway 52 and a second traffic density in a second direction along the roadway 52 opposite the first direction, and if the first traffic density is above a first traffic density threshold and the second traffic density is above the second traffic density threshold, generates and broadcasts the virtual lane-direction indicator 42*b*.

Figure 6A:
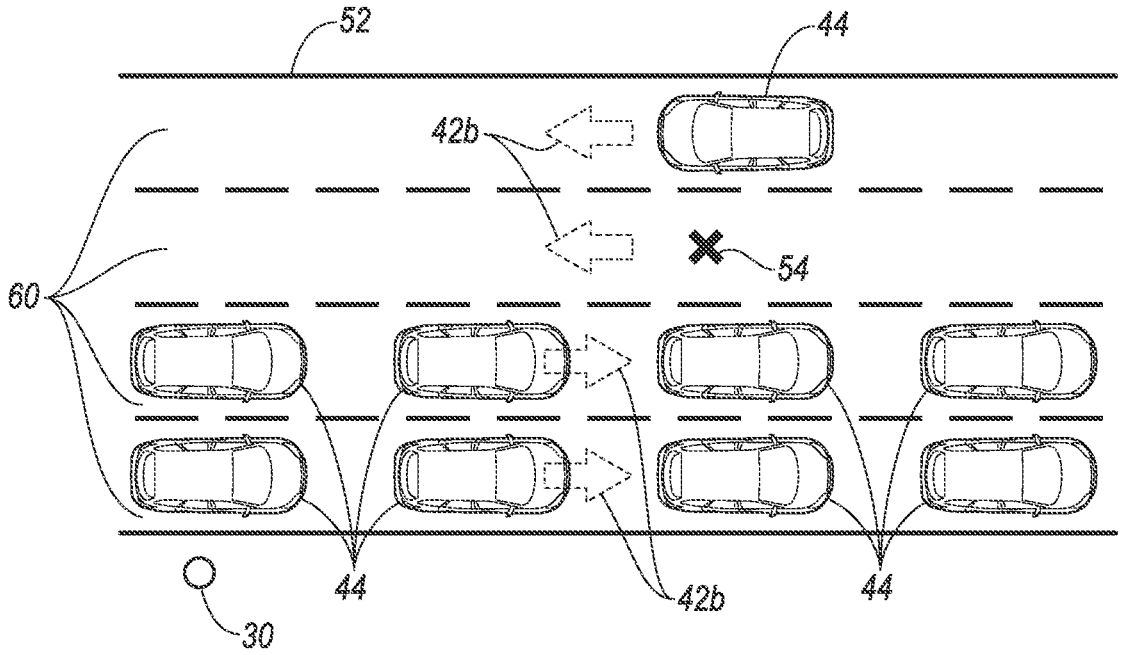
FIG. 6A is a diagram of the infrastructure system before generating the virtual lane-direction indicator.
Figure 6B:
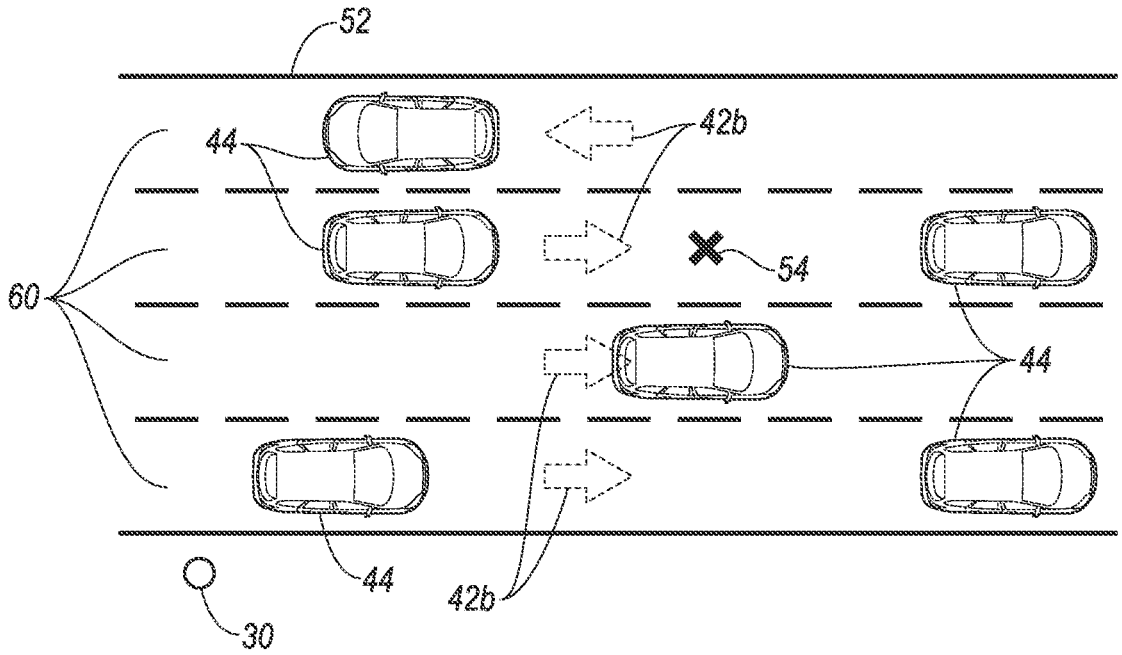
FIG. 6B is a diagram of the infrastructure system after generating the virtual lane-direction indicator.

The process 500 begins in a block 505, in which the computer 36 receives data from the at least one sensor 32 indicating respective locations and motions of the objects 38 in the environment surrounding the at least one sensor 32. For example, the data for each object 38 can have the form $(x, y, \theta, v_x, v_y, \omega)$, in which x and y are horizontal spatial coordinates, $\theta$ is a horizontal orientation, $v_x$ and $v_y$ are horizontal velocity components, and $\omega$ is a horizontal angular velocity. The objects 38 can be vehicles 44, as shown in FIGS. 6A-B.

Next, in a block 510, the computer 36 determines the first traffic density and the second traffic density. Traffic density can be represented as number of vehicles 44 per unit distance along a length of a street or road, e.g., number of vehicles 44 per kilometer. For example, the computer 36 can determine each traffic density by counting the number of vehicles 44 traveling in the respective direction along a section of roadway 52, as given by the data from the at least one sensor 32, and dividing that number by the length of the section of the roadway 52. The computer 36 may also receive data about current or expected traffic density outside the range of the at least one sensor 32 from a cloud server, e.g., associated with a city traffic management system. For example, the data can be a warning about an expected increase to the first or second traffic density based on an event such as a sports game or concert ending.

Next, in a decision block 515, the computer 36 determines whether the first traffic density, i.e., the density of the traffic in the first direction along the roadway 52, is above the first traffic density threshold. The first traffic density threshold is chosen to indicate congested traffic. For example, the first traffic density threshold can be chosen to be sufficiently high that the speed of traffic is decreasing as a result of the traffic density, i.e., to correspond to a saturation point of the traffic density. In general, as traffic density increases, average speed of traffic remains constant until the traffic density reaches a saturation point, which is defined as a traffic density beyond which the speed of traffic (i.e., average speed of vehicles at a point on a road) decreases. The saturation point typically depends on the number of lanes 60 of traffic in a direction and can be determined experimentally by observing the roadway 52 over time. The saturation point is a predetermined quantity for a given roadway 52, direction, and number of lanes 60 in that direction. The saturation point can be experimentally, i.e., empirically, determined by making many observations of the number of vehicles 44 on the roadway 52 and the speeds of the vehicles 44, from which traffic density and average speed can be calculated. The traffic density d is the number N of vehicles 44 on the roadway 52 divided by the length L of the roadway 52, i.e., $d=N/L$. The average speed $\bar{v}$ is the sum of the speeds $v_i$ of the vehicles 44 divided by the number N of the vehicles 44, i.e., $\bar{v}=(\Sigma_{i=1}^{N} v_i)/N$. The saturation point can be statistically determined by plotting the traffic density d versus the average speed $\bar{v}$. This process can be repeated for different numbers of lanes 60 in a given direction along the roadway 52. The first traffic density threshold corresponds to the predetermined saturation point for the number of lanes 60 in the first direction along the roadway 52, and the first traffic density threshold is stored in the memory of the computer 36. If the first traffic density is below the first traffic density threshold, the process 500 returns to the block 505 to continue monitoring the data from the at least one sensor 32. If the first traffic density is above the first traffic density threshold, the process 500 proceeds to a decision block 520.

In the decision block 520, the computer 36 determines whether the second traffic density, i.e., the density of the traffic in the second direction along the roadway 52 opposite the first direction, is below the second traffic density threshold. The second traffic density threshold is chosen to indicate light traffic. For example, the second traffic density threshold can be chosen to be below the saturation point, e.g., sufficiently far below the saturation point that eliminating a lane 60 of traffic in that direction will result in a traffic density that is still below the saturation point, as determined from experimentally observing the roadway 52 as described above. If the second traffic density is above the second traffic density threshold, the process 500 returns to the block 505 to continue monitoring the data from the at least one sensor 32. If the second traffic density is below the second traffic density threshold, the process 500 proceeds to a block 525.

In the block 525, the computer 36 generates the virtual lane-direction indicator 42*b*. The first location 54 is chosen to indicate a lane 60 of the roadway 52, e.g., a spatial coordinate in that lane 60 of the roadway 52. For example, the lane 60 of the roadway 52 can be the lane 60 in which traffic is currently traveling in the second direction and which borders a lane 60 in which traffic is currently traveling in the first direction, e.g., the second lane 60 from the top as shown in FIG. 6A. The virtual lane-direction indicator 42*b* points in the first direction. In other words, the lane 60 of traffic traveling in the second direction that is closest to the traffic traveling in the first direction is switched so that traffic instead travels in the first direction, as shown in FIG. 6B.

Next, in a block 530, the computer 36 instructs the transceiver 34 to broadcast the virtual lane-direction indicator 42*b* to the vehicles 44 in the environment. For example, the transceiver 34 can broadcast map data including the virtual lane-direction indicator 42*b*, such as an update to a map stored on the vehicle computers of the vehicles 44. The transceiver 34 may also broadcast a future time at which the virtual lane-direction indicator 42*b* takes effect. The future time can be chosen to provide sufficient time for vehicles 44 in the lane 60 traveling in the second direction to exit the lane 60. The computer 36 also transmits the virtual lane-direction indicator 42*b* to the cloud server so that the cloud server can communicate to vehicles 44 outside the range of the transceiver 34. After the block 530, the process 500 ends.

Figure 7:
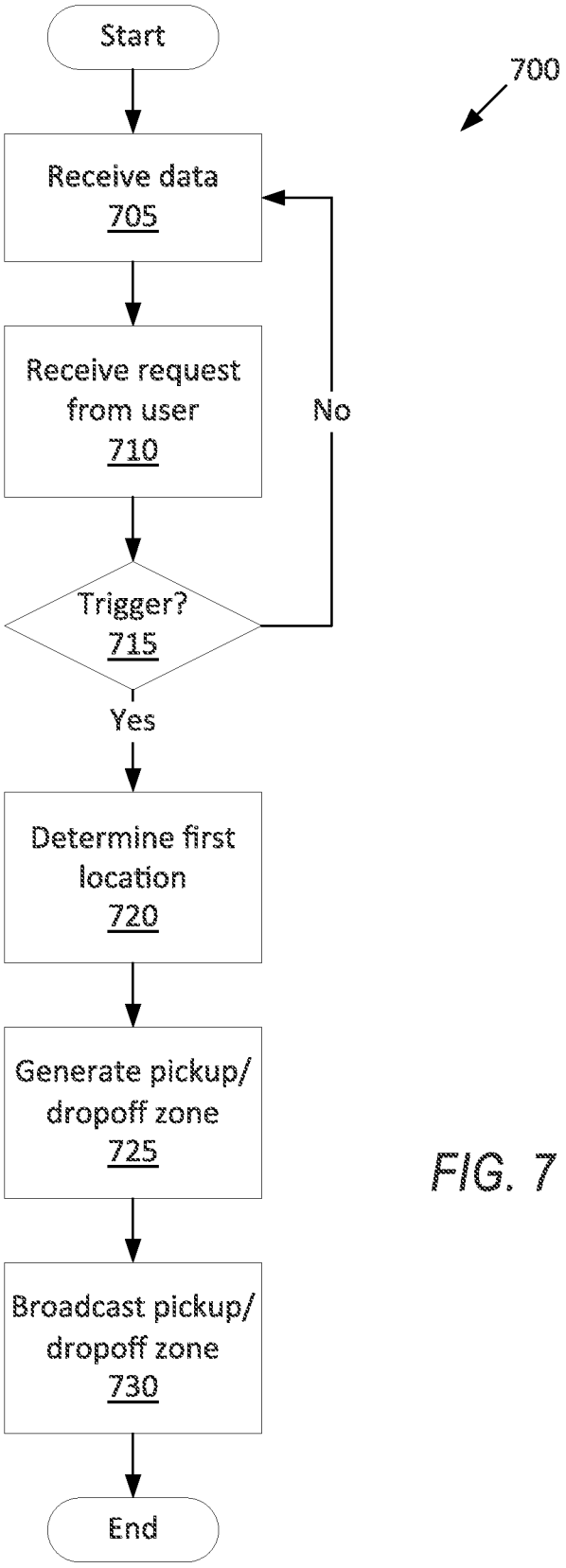
FIG. 7 is a process flow diagram of an example process for generating a virtual pickup/dropoff zone.

FIG. 7 is a process flow diagram illustrating an exemplary process 700 for generating a virtual traffic marker 42, in which the virtual traffic marker 42 is a virtual pickup/dropoff zone 42*c*. The memory of the computer 36 stores executable instructions for performing the steps of the process 700. As a general overview of the process 700, the computer 36 receives sensor data and a request from a user 40; and in response to the request, determines the first location 54 at which to generate the virtual pickup/dropoff zone 42*c*, and generates and broadcasts the virtual pickup/dropoff zone 42*c*.

Figure 8:
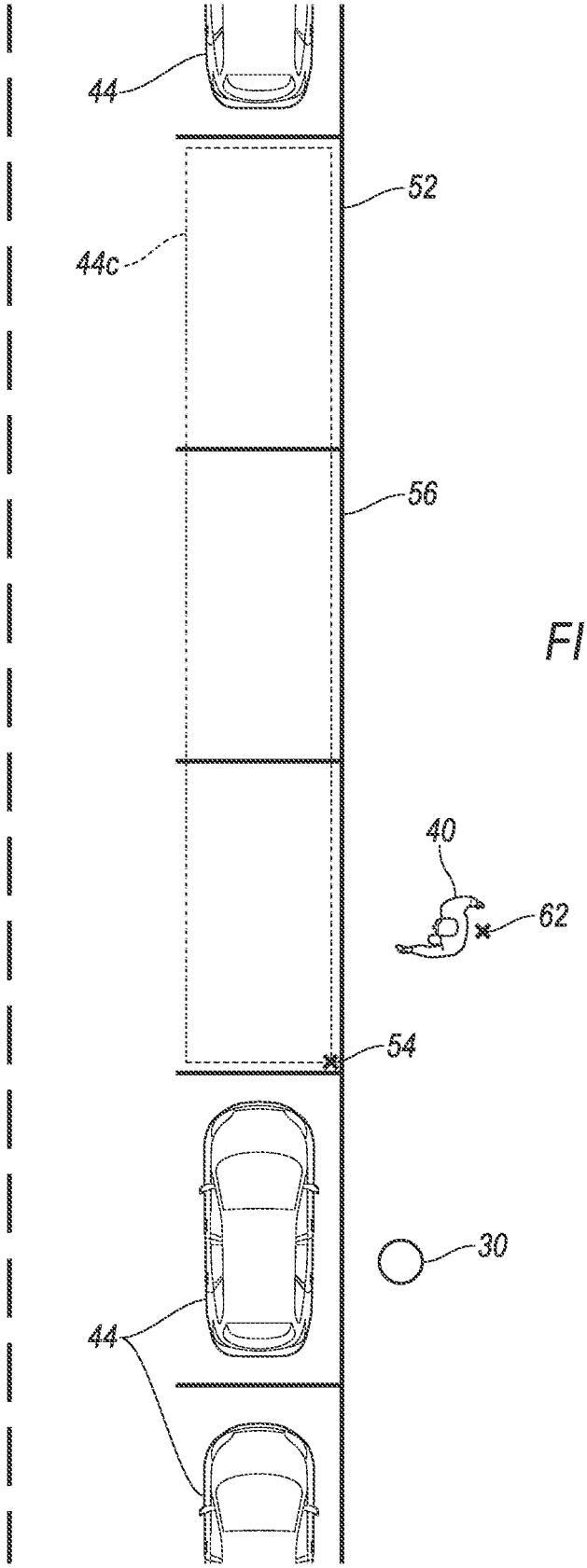
FIG. 8 is a diagram of the infrastructure system generating the virtual pickup/dropoff zone.

The process 700 begins in a block 705, in which the computer 36 receives data from the at least one sensor 32 indicating respective locations and motions of the objects 38 in the environment surrounding the at least one sensor 32. For example, the data for each object 38 can have the form $(x, y, \theta, v_x, v_y, \omega)$, in which x and y are horizontal spatial coordinates, $\theta$ is a horizontal orientation, $v_x$ and $v_y$ are horizontal velocity components, and $\omega$ is a horizontal angular velocity. The objects 38 can be vehicles 44, as shown in FIG. 8.

Next, in a block 710, the computer 36 receives the request from the user 40. The request includes data indicating that the user 40 wants a virtual pickup/dropoff zone 42*c* generated and indicating a second location 62 that is either a destination for the user 40 or a current location of the user 40. For example, the second location 62 can be a spatial coordinate representing the destination for the user or the current location of the user 40.

Next, in a block 715, the computer 36 determines whether the request from the user 40 to generate the virtual pickup/dropoff zone 42*c* has been received by the transceiver 34. In response to the request, the process 700 proceeds to a block 720. If no request has been received, the process 700 returns to the block 705 to continue monitoring the data from the at least one sensor 32 and awaiting the request.

In the block 720, the computer 36 determines the first location 54 for the virtual pickup/dropoff zone 42*c*. The first location 54 is based on the second location 62 and based on the data from the at least one sensor 32 indicating locations of stationary vehicles 44 in the environment. For example, the first location 54 can be where a minimum distance along the first roadside 56 is unoccupied by stationary vehicles 44. The first roadside 56 can be a side of the roadway 52 on which the second location 62 is located. If there is more than one eligible location for the first location 54, the first location 54 can be the eligible location closest to the second location 62. The minimum distance is chosen to allow a vehicle 44 to travel into, or into and out of, the virtual pickup/dropoff zone 42*c* without reversing, i.e., while traveling forward. For example, the minimum distance can be at least as long as two consecutive parallel parking spaces, e.g., as long as three consecutive parallel parking spaces as shown in FIG. 8, or as long as four consecutive parking spaces.

Next, in a block 725, the computer 36 generates the virtual pickup/dropoff zone 42*c* at the first location 54 in the environment. The virtual pickup/dropoff zone 42*c* can be represented as map data. For example, the virtual pickup/dropoff zone 42*c* can be represented as a set of vertices of the area encompassed by the virtual pickup/dropoff zone 42*c*. The computer 36 can use the first location 54 as a reference point from which to locate the area encompassed by the virtual pickup/dropoff zone 42*c*, e.g., at the first roadside 56 at the farthest position upstream relative to the direction of traffic along the first roadside 56, as shown in FIG. 8. For example, the virtual pickup/dropoff zone 42*c* can have a predefined length along the first roadside 56 starting at the first location 54 and extending in the direction of traffic a distance equal to the minimum distance, and the virtual pickup/dropoff zone 42*c* can have a predefined width starting at the first location 54 and extending perpendicular to the first roadside 56 into the roadway 52 a distance equal to a standard width of a parallel parking space.

Next, in a block 730, the computer 36 instructs the transceiver 34 to broadcast the virtual pickup/dropoff zone 42*c* to the vehicles 44 in the environment. For example, the transceiver 34 can broadcast map data including the virtual pickup/dropoff zone 42*c*, such as an update to a map stored on the vehicle computers of the vehicles 44. The virtual pickup/dropoff zone 42*c* indicates to vehicles 44 that parking is prohibited in the virtual pickup/dropoff zone 42*c* other than the vehicle 44 associated with the user 40 that requested the virtual pickup/dropoff zone 42*c*. After the block 730, the process 700 ends.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer executable instructions may be compiled or interpreted from computer programs created using a variety of programming languages and/or technologies, including, without limitation, and either alone or in combination, Java™, C, C++, Matlab, Simulink, Stateflow, Visual Basic, Java Script, Python, Perl, HTML, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in a computing device is generally a collection of data stored on a computer readable medium, such as a storage medium, a random access memory, etc.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a ECU. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), a nonrelational database (NoSQL), a graph database (GDB), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

In the drawings, the same reference numbers indicate the same elements. Further, some or all of these elements could be changed. With regard to the media, processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary. The adjectives "first" and "second" are used throughout this document as identifiers and are not intended to signify importance, order, or quantity.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A computer comprising a processor and a memory storing instructions executable by the processor to:

receive data from at least one sensor indicating locations and motions of objects in an environment surrounding the at least one sensor;

in response to one of (a) the data from the at least one sensor or (b) a request from a user, generate a virtual traffic marker at a first location in the environment, wherein the first location is based on the data from the at least one sensor or included in the request, and the virtual traffic marker is data including the first location and traffic instructions corresponding to the first location; and instruct a transceiver to broadcast the virtual traffic marker to vehicles in the environment;

wherein the virtual traffic marker is a virtual lane-direction indicator; and the first location indicates a lane of the roadway.

2. The computer of claim 1, wherein the instructions further include to, in response to one of (a) the data from the at least one sensor or (b) a second request from the user, generate a second virtual traffic marker at a second location in the environment, wherein the second location is based on the data from the at least one sensor or included in the second request, and the second virtual traffic marker is data including the second location and traffic instructions corresponding to the second location; and instruct the transceiver to broadcast the second virtual traffic marker to vehicles in the environment; the second virtual traffic marker includes at least one of a virtual parking place, a virtual crosswalk, a virtual lane-direction indicator, a virtual lane marker, a virtual designation of a road as a toll road, or a virtual pickup/dropoff zone.

3. The computer of claim 2, wherein the second virtual traffic marker is the virtual crosswalk, and the instructions further include to, in response to the second request from the user to generate the virtual crosswalk, generate the virtual crosswalk at the second location.

4. The computer of claim 3, wherein the instructions further include to instruct a light projector to project light in a shape indicating the virtual crosswalk at the second location in the environment.

5. The computer of claim 3, wherein the second request from the user includes the second location.

6. The computer of claim 3, wherein the instructions further include to decline to generate the virtual crosswalk upon determining that an area encompassed by the virtual crosswalk intersects at least one object that is stationary in the environment.

7. The computer of claim 3, wherein the instructions further include to decline to generate the virtual crosswalk upon determining that a priority vehicle is approaching the second location.

8. The computer of claim 2, wherein the second virtual traffic marker is the virtual pickup/dropoff zone, and the instructions further include to, in response to the second request from the user to generate the virtual pickup/dropoff zone, generate the virtual pickup/dropoff zone at the second location.

9. The computer of claim 8, wherein the second location is based on data from the at least one sensor indicating locations of stationary vehicles in the environment.

10. The computer of claim 9, wherein the instructions further include to determine the second location as where a minimum distance along a roadside is unoccupied by stationary vehicles.

11. The computer of claim 10, wherein the minimum distance is at least as long as two consecutive parallel parking spaces.

12. The computer of claim 1, wherein instructing the transceiver to broadcast the virtual traffic marker includes instructing the transceiver to broadcast map data including the virtual traffic marker.

13. The computer of claim 1, wherein the instructions further include to, in response to the data from the at least one sensor indicating that traffic in a first direction along a roadway is above a first traffic density threshold and that traffic in a second direction opposite the first direction along the roadway is below a second traffic density threshold, generate the virtual lane-direction indicator.

14. The computer of claim 13, wherein the first traffic density threshold is greater than the second traffic density threshold, and the virtual lane-direction indicator points in the first direction.

15. The computer of claim 1, wherein the instructions further include to, in response to the data from the at least one sensor indicating that traffic in a first direction along a roadway is above a first traffic density threshold, generate the virtual lane-direction indicator.

16. The computer of claim 1, wherein the data from the at least one sensor includes data from at least one of a camera or a LIDAR.

17. A method comprising:

receiving data from at least one sensor indicating locations and motions of objects in an environment surrounding the at least one sensor;

in response to one of (a) the data from the at least one sensor or (b) a request from a user, generating a virtual traffic marker at a first location in the environment, wherein the first location is based on the data from the at least one sensor or included in the request, and the virtual traffic marker is data including the first location and traffic instructions corresponding to the first location; and instructing a transceiver to broadcast the virtual traffic marker to vehicles in the environment;

wherein the virtual traffic marker is a virtual lane-direction indicator; and the first location indicates a lane of the roadway.

18. The method of claim 17, further comprising, in response to the data from the at least one sensor indicating that traffic in a first direction along a roadway is above a first traffic density threshold and that traffic in a second direction opposite the first direction along the roadway is below a second traffic density threshold, generating the virtual lane-direction indicator.

19. The method of claim 17, further comprising, in response to the data from the at least one sensor indicating that traffic in a first direction along a roadway is above a first traffic density threshold, generating the virtual lane-direction indicator.

20. A computer comprising a processor and a memory storing instructions executable by the processor to:

receive data from at least one sensor indicating locations and motions of objects in an environment surrounding the at least one sensor;

in response to a request from a user to generate a virtual pickup/dropoff zone, generate the virtual pickup/dropoff zone at a first location in the environment, wherein the first location is based on the data from the at least one sensor indicating locations of stationary vehicles in the environment, and the virtual pickup/dropoff zone is data including the first location and traffic instructions corresponding to the first location;

determine the first location as where a minimum distance along a roadside is unoccupied by stationary vehicles, the minimum distance being at least as long as two consecutive parallel parking spaces; and instruct a transceiver to broadcast the virtual pickup/dropoff zone to vehicles in the environment.

* * * * *